US010760144B2

(12) United States Patent
Yoshimoto et al.

(10) Patent No.: US 10,760,144 B2
(45) Date of Patent: Sep. 1, 2020

(54) METHOD FOR MANUFACTURING METAL SHEET AND RAPID QUENCHING UNIT

(71) Applicant: JFE STEEL CORPORATION, Tokyo (JP)

(72) Inventors: Soshi Yoshimoto, Fukuyama (JP); Masaru Miyake, Fukuyama (JP); Gentaro Takeda, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 252 days.

(21) Appl. No.: 15/531,081

(22) PCT Filed: Sep. 1, 2015

(86) PCT No.: PCT/JP2015/004432
§ 371 (c)(1),
(2) Date: May 26, 2017

(87) PCT Pub. No.: WO2016/084283
PCT Pub. Date: Jun. 2, 2016

(65) Prior Publication Data

US 2017/0327926 A1 Nov. 16, 2017

(30) Foreign Application Priority Data

Nov. 28, 2014 (JP) ..... 2014-240836

(51) Int. Cl.
*C21D 9/56* (2006.01)
*C21D 1/18* (2006.01)
(Continued)

(52) U.S. Cl.
CPC ..... *C21D 9/563* (2013.01); *C21D 1/18* (2013.01); *C21D 1/63* (2013.01); *C21D 1/667* (2013.01);
(Continued)

(58) Field of Classification Search
CPC . C21D 1/18; C21D 1/63; C21D 1/667; C21D 2211/008; C21D 9/46; C21D 9/562;
(Continued)

(56) References Cited

U.S. PATENT DOCUMENTS

2006/0060271 A1* 3/2006 Fujibayashi ..... B21B 45/0218 148/638

FOREIGN PATENT DOCUMENTS

CN 102041375 A 5/2011
EP 2314722 A1 4/2011
(Continued)

OTHER PUBLICATIONS

Extended European Search Report for European Application No. 15862866.9, dated Sep. 27, 2017, 7 pages.
(Continued)

*Primary Examiner* — Jenny R Wu
(74) *Attorney, Agent, or Firm* — RatnerPrestia

(57) ABSTRACT

A method for manufacturing a metal sheet comprising pinching the metal sheet in rapid quenching between a pair of pinch rolls in the range where the temperature of the metal sheet is from ($T_{Ms}$+150) (° C.) to ($T_{Mf}$−150) (° C.), wherein the Ms temperature of the metal sheet is $T_{Ms}$ (° C.) and the Mf temperature thereof is $T_{Mf}$ (° C.), as well as a rapid quenching unit comprising a pair of pinch rolls capable of use in such a method.

5 Claims, 2 Drawing Sheets

(51) Int. Cl.

| | |
|---|---|
| ***C21D 9/573*** | (2006.01) |
| ***C21D 1/63*** | (2006.01) |
| ***C21D 1/667*** | (2006.01) |
| ***C21D 9/46*** | (2006.01) |

(52) U.S. Cl.
CPC ..... *C21D 9/46* (2013.01); *C21D 9/573* (2013.01); *C21D 9/5735* (2013.01); *C21D 9/5737* (2013.01); *C21D 9/562* (2013.01); *C21D 2211/008* (2013.01)

(58) Field of Classification Search
CPC ..... C21D 9/563; C21D 9/573; C21D 9/5735; C21D 9/5737
See application file for complete search history.

(56) References Cited

FOREIGN PATENT DOCUMENTS

| | | | | |
|---|---|---|---|---|
| GB | 1148912 | A | | 4/1969 |
| GB | 1528529 | | | 10/1978 |
| JP | 462733 | Y1 | | 1/1971 |
| JP | 5218124 | B1 | | 5/1977 |
| JP | S5218124 | B1 | * | 5/1977 |
| JP | 59153843 | A | | 9/1984 |
| JP | 04289130 | A | * | 10/1992 |
| JP | H04289130 | A | | 10/1992 |
| JP | 08176884 | A | * | 7/1996 |
| JP | 08176884 | A | | 9/1996 |
| JP | 2003277833 | A | * | 10/2003 |
| JP | 2003277833 | A | | 10/2003 |
| JP | 2011184773 | A | | 9/2011 |

OTHER PUBLICATIONS

Japanese Office Action/Notice of Allowance with partial English language translation for Application No. JP 2016-561218, dated Jan. 17, 2017, 4 pages.

Korean Office Action for Korean Application No. 10-2017-7013434, dated Oct. 1, 2018 with Concise Statement of Relevance of Office Action, 6 pages.

Chinese Office Action for Chinese Application No. 201580064254.2, dated Sep. 17, 2017 with Concise Statement of Relevance of Office Action, 6 pages.

International Search Report and Written Opinion for International Application No. PCT/JP2015/004432, dated Dec. 1, 2015—4 Pages 2017.

Chinese Office Action for Chinese Application No. 201580064254,2, dated Feb. 14, 2018 with Concise Statement of Relevance of Application, 8 pages.

* cited by examiner

METHOD FOR MANUFACTURING METAL SHEET AND RAPID QUENCHING UNIT

CROSS REFERENCE TO RELATED APPLICATIONS

This is the U.S. National Phase application of PCT/JP2015/004432, filed Sep. 1, 2015, which claims priority to Japanese Patent Application No. 2014-240836, filed Nov. 28, 2014, the disclosures of each of these applications being incorporated herein by reference in their entireties for all purposes.

TECHNICAL FIELD OF THE INVENTION

The present invention relates to a method for manufacturing a metal sheet in such a manner that shape defects caused in the metal sheet during rapid quenching are suppressed using a continuous annealing line for performing heating, soaking, cooling, and reheating while the metal sheet is being continuously fed and also relates to a rapid quenching unit.

BACKGROUND OF THE INVENTION

In the manufacture of metal sheets including steel sheets, properties are adjusted in such a manner that phase transformation is induced by cooling the metal sheets in a continuous annealing line after heating. In recent years, high-tensile strength steel sheets have been increasingly used in the automotive industry for the purpose of achieving the weight reduction and crash safety of automobiles. In order to respond to such a demand trend, the importance of rapid cooling techniques advantageous in manufacturing high-tensile strength steel sheets is growing. A water quenching method having the highest cooling rate is generally a way to rapidly cool a steel sheet in such a manner that cooling water is applied to the steel sheet from quenching nozzles placed in water at the same time that the heated steel sheet is immersed in water. In this method, there is a problem in that shape defects are caused in a metal sheet by out-of-plane deformation including camber and wavy deformation.

Patent Literature 1 proposes a technique in which bridle rolls are provided upstream and downstream of a rapid quenching section as tension-changing means capable of changing the tension of a steel sheet subjected to a rapid quenching step for the purpose of reducing the wavy deformation of a metal sheet that occurs during rapid quenching in a continuous annealing furnace.

Patent Literature 2 proposes a technique in which, in consideration of the fact that shape defects are caused because compressive thermal stress is generated in lateral directions of a metal sheet at a quenching start temperature (cooling start temperature) and therefore the metal sheet buckles, out-of-plane deformation is reduced in such a manner that both sides of the metal sheet are pinched at a region having the compressive stress generated in the lateral directions of the metal sheet by cooling or another region close thereto.

PATENT LITERATURE

PTL 1: Japanese Unexamined Patent Application Publication No. 2011-184773

PTL 2: Japanese Unexamined Patent Application Publication No. 2003-277833

SUMMARY OF THE INVENTION

However, the technique proposed in Patent Literature 1 may possibly cause the fracture of a steel sheet because high tension is applied to the steel sheet with high temperature. Furthermore, a large thermal crown is caused in the bridle rolls which are placed upstream of the rapid quenching section and which are brought into contact with the steel sheet with high temperature. The bridle rolls are brought into contact with the steel sheet unevenly in the lateral directions of the bridle rolls. As a result, there is a problem in that the steel sheet buckles or flaws and therefore the shape of the steel sheet cannot be improved.

As a result of verifying the technique proposed in Patent Literature 2, it has become clear that the effect of correcting a shape is small.

The present invention has been made to solve the above problem. It is an object of the present invention to provide a method for manufacturing a metal sheet and a rapid quenching unit, the method and the rapid quenching unit being capable of effectively suppressing shape defects caused in the metal sheet during rapid quenching.

The inventors have performed intensive investigations to solve the above problem and, as a result, have obtained findings below. In a method for manufacturing a metal sheet, microstructure control inducing martensite transformation in the metal sheet during rapid cooling is used in some cases. The occurrence of martensite transformation causes the volume expansion of a microstructure and therefore a complicated, uneven irregular shape is formed. A high-tensile strength steel sheet having a martensite microstructure becomes out of shape because the highest stress acts in the steel sheet in the vicinity from the Ms temperature at which transformation expansion occurs during thermal shrinkage to the Mf temperature during rapid quenching. As used herein, the term "Ms temperature" refers to the temperature at which martensite transformation starts and the term "Mf temperature" refers to the temperature at which martensite transformation finishes.

The inventors have devised a method for manufacturing a metal sheet having features below and a rapid quenching unit on the basis of these findings.

[1] In a method for manufacturing a metal sheet using a continuous annealing line including a rapid quenching unit for cooling the metal sheet by immersing the metal sheet in a liquid, the metal sheet in rapid quenching is pinched between a pair of pinch rolls placed in the liquid in the range where the temperature of the metal sheet is from ($T_{Ms}$+150) (° C.) to ($T_{Mf}$−150) (° C.), $T_{Ms}$ (° C.) is a Ms temperature at which the martensite transformation of the metal sheet starts, $T_{Mf}$ (° C.) is a Mf temperature at which the martensite transformation thereof finishes.

[2] In the method for manufacturing the metal sheet specified in Item [1], the pinch position of each pinch roll is set on the basis of a feed rate, a thickness, and a quenching start temperature of the metal sheet.

[3] In the method for manufacturing the metal sheet specified in Item [1] or [2], a distance d (mm) from a water surface to a rotation center of the pinch roll is given by a formula below.

[Math. 1]

$$v \times \frac{t(T - T_{Ms} - 150)}{1.5} \leq d \leq v \times \frac{t(T - T_{Mf} + 150)}{1.5}$$

$T_{Ms}$ (° C.) is the Ms temperature of the metal sheet, $T_{Mf}$ (° C.) is Mf temperature of the metal sheet, v (m/s) is the threading speed, t (mm) is a thickness of the metal sheet, T (° C.) is a quenching start temperature, and d (mm) is the distance from the water surface to the rotation center of each pinch roll.

[4] In the method for manufacturing the metal sheet specified in any one of Items [1] to [3], the rapid quenching unit includes water ejecting devices for ejecting cooling water to the front surface and back surface of the metal sheet and a pair of the pinch rolls pinch the metal sheet placed between the metal sheet and the water ejecting devices.

[5] A rapid quenching unit for cooling a high-temperature metal sheet by immersing the metal sheet in a liquid includes a pair of pinch rolls. Supposing that the Ms temperature of the metal sheet is $T_{Ms}$ (° C.) and the Mf temperature thereof is $T_{Mf}$ (° C.), the pinch rolls pinch the metal sheet in the range where the temperature of the metal sheet is from ($T_{Ms}$+150) (° C.) to ($T_{Mf}$−150) (° C.).

[6] The rapid quenching unit specified in Item [5] includes water ejecting devices for ejecting cooling water to the front surface and back surface of the metal sheet. The pinch rolls are placed between the metal sheet and the water ejecting devices.

In accordance with a method for manufacturing a metal sheet and a rapid quenching unit according to embodiments of the present invention, shape defects caused in the metal sheet during rapid quenching can be effectively suppressed.

DETAILED DESCRIPTION OF EMBODIMENTS OF THE INVENTION

Embodiments of the present invention are described below with reference to the attached drawings.

Figure 1:
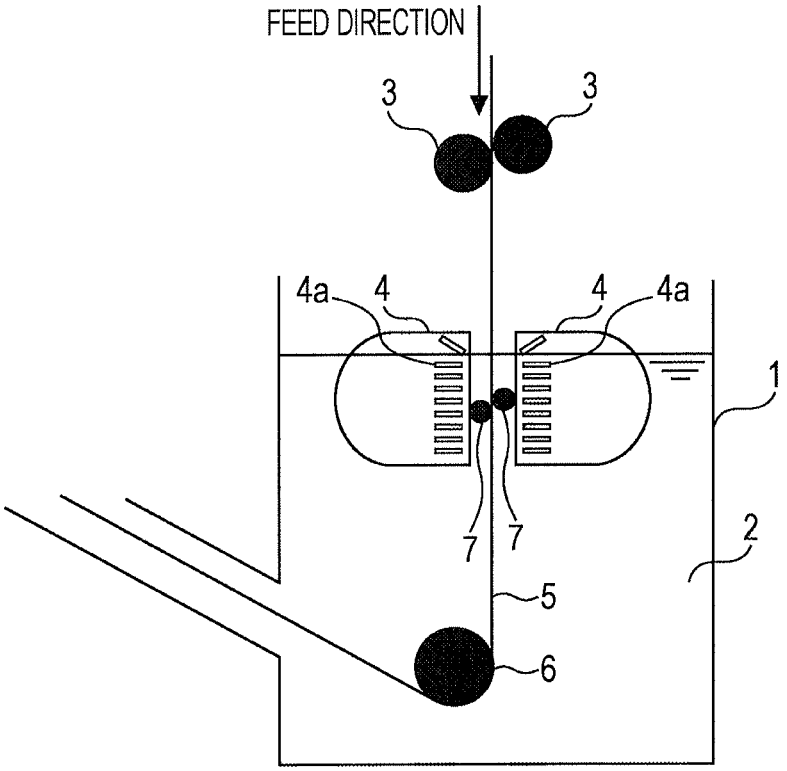
FIG. 1 is an illustration of a rapid quenching unit according to an embodiment of the present invention.

FIG. 1 is an illustration of a rapid quenching unit according to an embodiment of the present invention. The rapid quenching unit is used in a cooling line placed on the delivery side of a soaking zone of a continuous annealing furnace. In FIG. 1, a pair of seal rolls 3 placed at an outlet of the soaking zone of the continuous annealing furnace is shown. The rapid quenching unit includes a water tank 1 filled with water 2 (liquid); water ejecting devices 4, placed in the water tank 1, for applying cooling water to a metal sheet 5 to cool the metal sheet 5 to the water temperature; and a sink roll 6 which immerses the metal sheet 5 in the water tank 1 and which changes the transport direction of the metal sheet 5.

The water ejecting devices 4 are partly placed in the water tank 1. The water ejecting devices 4 are arranged on the front side and back side of the metal sheet 5 with a predetermined spaced therebetween. The water ejecting devices 4, which are arranged on the front and back sides thereof, each include nozzles 4*a* extending in a lateral direction of the metal sheet 5. The nozzles 4*a* are arranged in the transport direction of the metal sheet 5. The water ejecting devices 4 eject cooling water from the nozzles 4*a* to the metal sheet 5 to rapidly cool the metal sheet 5.

The metal sheet 5 that is below the water surface is thermally shrunk by rapidly cooling the metal sheet 5 with cooling water. In particular, when the temperature of the metal sheet 5 is reduced to the Mf temperature that is the temperature at which martensite transformation finishes from the Ms temperature that is the temperature at which martensite transformation starts, rapid thermal shrinkage and transformation expansion occur in the metal sheet 5 together to maximize the stress acting in the metal sheet 5 and the metal sheet 5 becomes out of shape.

Therefore, according to embodiments of the present invention, supposing that the Ms temperature of the metal sheet is $T_{Ms}$ (° C.) and the Mf temperature thereof is $T_{Mf}$ (° C.), pinch rolls 7 pinching the metal sheet 5 in rapid quenching are placed below the water surface in the range where the temperature of the metal sheet 5 is from ($T_{Ms}$+150) (° C.) to ($T_{Mf}$−150) (° C.). In particular, a pair of the pinch rolls 7 are placed in spaces between the metal sheet 5 and the nozzles 4*a* of the water ejecting devices 4 so as to pinch both sides of the metal sheet 5. The reason why the position of each pinch roll 7 is in a region from the Ms temperature plus 150° C. to the Mf temperature minus 150° C. is that the camber was sufficiently reduced in this range in an example described below with reference to FIG. 4.

The Ms temperature and the Mf temperature can be calculated from the composition of the metal sheet 5.

A pair of the pinch rolls 7 are preferably placed such that the center axes thereof are misaligned in the transport direction of the metal sheet 5. Placing the pinch rolls 7 such that the center axes thereof are misaligned enables the pinching force of the metal sheet 5 to be increased, thereby enabling the shape correction force to be increased.

The preferred position of each pinch roll 7 is preferably set on the basis of the sheet feed rate v (m/s), the sheet thickness t (mm), and the quenching start temperature T (° C.). Supposing that the cooling rate is 1,500/t (° C./s), the position from the water surface that the temperature of the metal sheet 5 is ($T_{Ms}$+150) (° C.) can be given by Formula (1). Incidentally, the cooling rate is a value determined depending on the sheet thickness or the like. When the sheet thickness is 1 mm, the cooling rate is 1,000/t to 2,000/t (° C./s). Therefore, in embodiments of the present invention, the cooling rate is 1,500/t (° C./s), which is an intermediate value. The cooling rate can be appropriately set depending on the sheet thickness and the like.

[Math. 2]

$$v \times \frac{(T - (T_{Ms} + 150))}{\frac{1500}{t}\,(\text{m})} = v \times \frac{t(T - T_{Ms} - 150)}{1.5\,(\text{mm})} \quad (1)$$

Likewise, the position from the water surface that the temperature of the metal sheet 5 is ($T_{Mf}$−150) (° C.) can be given by Formula (2).

[Math. 3]

$$v \times \frac{(T - (T_{Mf} - 150))}{\frac{1500}{t}\ (\mathrm{m})} = v \times \frac{t(T - T_{Mf} + 150)}{1.5\ (\mathrm{mm})} \quad (2)$$

Thus, the distance d (mm) from the water surface to the rotation center of each pinch roll 7 is preferably given by Formula (3).

[Math. 4]

$$v \times \frac{t(T - T_{Ms} - 150)}{1.5} \leq d \leq v \times \frac{t(T - T_{Mf} + 150)}{1.5} \quad (3)$$

The rotation center of the pinch roll 7 corresponds to the pinch position of the metal sheet 5 pinched between the pinch rolls 7. Referring to FIG. 1, the two pinch rolls 7, which pinch the metal sheet 5, are placed so as to be misaligned in the transport direction of the metal sheet 5. The position of each pinch roll 7 preferably satisfies the above-mentioned range.

In embodiments of the present invention, since the pinch rolls 7, which can pinch the metal sheet 5, are placed below the water surface in the range where the temperature of the metal sheet 5 is from the Ms temperature to the Mf temperature, the shape of the metal sheet 5 can be effectively corrected in such a manner that the metal sheet 5 is pinched at a position at which the highest stress acts in the metal sheet 5.

As described above, embodiments of the present invention are intended to reduce a complicated, uneven irregular shape that is caused when martensite transformation occurs during the rapid cooling of a steel sheet to expand the volume of a microstructure. Embodiments of the present invention are preferably applied to a method for manufacturing a high-strength cold-rolled steel sheet (Haiten).

In particular, embodiments of the present invention are preferably applied to a method for manufacturing a steel sheet with a tensile strength of 580 MPa or more. The upper limit of the tensile strength is not particularly limited and is, for example, 1,600 MPa or less. An example of the composition of the high-strength cold-rolled steel sheet is as follows: C is 0.04% to 0.220%, Si is 0.01% to 2.00%, Mn is 0.80% to 2.80%, P is 0.001% to 0.090%, S is 0.0001% to 0.0050%, and sol. Al is 0.005% to 0.065% on a mass basis, the remainder being Fe and inevitable impurities. At least one or more of Cr, Mo, Nb, V, Ni, Cu, and Ti are 0.5% or less as required. B and/or Sb is 0.01% or less as required.

Example

A high-tensile strength cold-rolled steel sheet having a thickness of 1.0 mm, a width of 1,000 mm, and a tensile strength of about 1,470 MPa was manufactured at a feed rate of 1.0 m/s using a rapid quenching unit shown in FIG. 1. The quenching start temperature T of the steel sheet is 740° C., the quenching finish temperature thereof is 50° C., the Ms temperature $T_{Ms}$ thereof is 350° C., and the Mf temperature $T_{Mf}$ thereof is 250° C.

Figure 2:
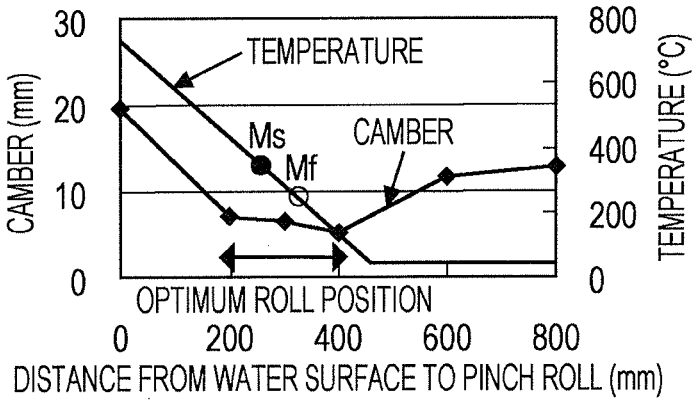
FIG. 2 is a graph showing the relationship between the position of the rotation center of a pinch roll and the camber of a steel sheet after the pinch roll passed in an example.
Figure 3:
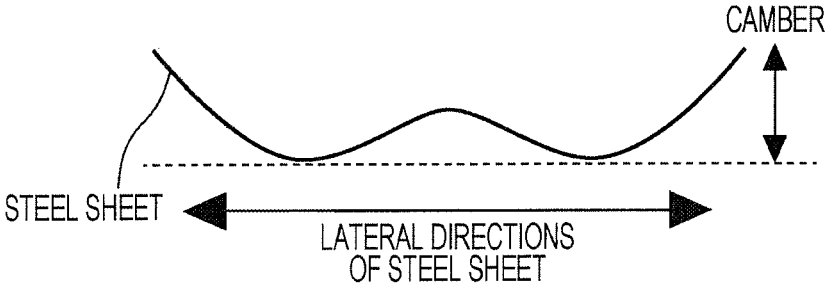
FIG. 3 is an illustration showing the camber used in FIG. 2.

FIG. 2 shows the relationship between the distance from the water surface to the rotation center of each pinch roll and the camber of the steel sheet after the roll passed. FIG. 3 shows the definition of the camber. In particular, the camber was defined as the highest position when the steel sheet was placed on the horizontal.

In FIG. 2, the horizontal axis represents the distance from the water surface of a water tank 1 to the pinch roll 7 and the vertical axis represents the camber of the steel sheet. The steel sheet is pinched between the pinch rolls 7 at a position which is 200 mm to 400 mm below the water surface and at which the temperature of the steel sheet is from the Ms temperature to the vicinity of the Mf temperature, whereby the camber is reduced to 10 mm or less.

In order to investigate the influence of the feed rate of a steel sheet, high-tensile strength cold-rolled steel sheets having a thickness of 1.0 mm, a width of 1,000 mm, and a tensile strength of about 1,470 MPa were manufactured at a feed rate of 1.0 m/s, 1.5 m/s, or 2.0 m/s using the rapid quenching unit shown in FIG. 1. The quenching start temperature is 740° C., the quenching finish temperature is 50° C., the Ms temperature $T_{Ms}$ is 350° C., and the Mf temperature $T_{Mf}$ is 250° C.

Figure 4:
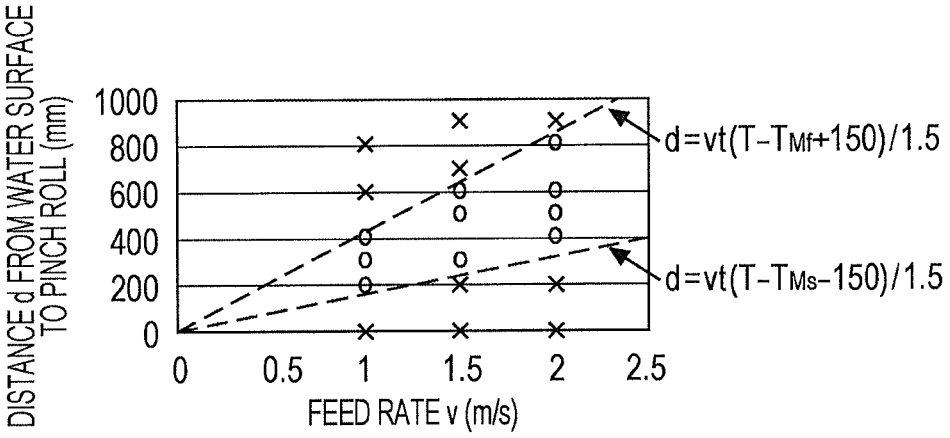
FIG. 4 is a graph showing the relationship between the feed rate v (m/s) of a steel sheet and the distance d (mm) from the water surface to the rotation center of a pinch roll.

FIG. 4 is a graph showing the relationship between the feed rate v (m/s) of each steel sheet and the distance d (mm) from the water surface to the rotation center of each roll. In a combination of the feed rate v (m/s) of the steel sheet and the distance d (mm) from the water surface to the rotation center of the roll, the camber of the steel sheet was measured. A camber of less than 10 mm was rated "○" and a camber of 10 mm or more was rated "x".

When the relationship between the Ms temperature $T_{Ms}$ of a steel sheet, the Mf temperature $T_{Mf}$ thereof, the feed rate v (m/s) thereof, the thickness t (mm) thereof, the quenching start temperature T (° C.) thereof, and the distance d (mm) from the water surface to each pinch roll 7 was in the range $vt(T-T_{Ms}-150)/1.5 \leq d \leq vt(T-T_{Mf}+150)/1.5$, a good result was obtained.

In this embodiment, an apparatus for water-cooling a steel sheet has been exemplified. The present invention is not necessarily limited to this. The technical concept of the present invention is broad, can be used to cool all metal sheets other than steel sheets, and can be applied to all rapid quenching units other than water-cooling units.

REFERENCE SIGNS LIST

1 Water tank
2 Water
3 Seal rolls
4 Water ejecting devices
4*a* Nozzles
5 Metal sheet
6 Sink roll
7 Pinch rolls

The invention claimed is:

1. A quenching unit for cooling a metal sheet by immersing the metal sheet in a liquid, comprising a pair of pinch rolls and a water ejecting device for ejecting cooling water to a front surface and back surface of the metal sheet, wherein the pinch rolls are placed between the metal sheet and at least one nozzle of the water ejecting device in a direction perpendicular to a surface of the metal sheet, and wherein the pinch rolls pinch the metal sheet in the range where the temperature of the metal sheet is from $(T_{Ms}+150)$ (° C.) to $(T_{Mf}-150)$ (° C.), $T_{Ms}$ (° C.) is a Ms temperature of the metal sheet, and $T_{Mf}$ (° C.) is a Mf temperature thereof.

2. A method for manufacturing a metal sheet using a continuous annealing line including a quenching unit as recited in claim 1 for cooling the metal sheet by immersing the metal sheet in a liquid, the method comprising pinching the metal sheet in rapid quenching between the pair of pinch rods placed in the liquid in a range where a temperature of the metal sheet is from ($T_{Ms}$+150) (° C.) to ($T_{Ms}$·150) (° C.), and ejecting cooling water with the water ejecting device to a front surface and back surface of the metal sheet, with the pinch rolls placed between the metal sheet and the at least one nozzle of the water electing device in the direction perpendicular to the respective surface of the metal sheet, and wherein $T_{Ms}$ (° C.) is a Ms temperature at which the martensite transformation of the metal sheet starts, $T_{Ms}$ (° C.) is a Mf temperature at which the martensite transformation thereof finishes.

3. The method for manufacturing the metal sheet according to claim 2, wherein a pinch position of the pair of pinch rolls is set on the basis of a threading speed, a thickness, and a quenching start temperature of the metal sheet.

4. The method for manufacturing the metal sheet according to claim 3, wherein a distance d (mm) from a water surface to a rotation center of the pinch roll is given by the following formula:

[Math. 1]

$$v \times \frac{t(T - T_{Ms} - 150)}{1.5} \leq d \leq v \times \frac{t(T - T_{Mf} + 150)}{1.5}$$

$T_{Ms}$ (° C.) is the Ms temperature of the metal sheet, $T_{Mf}$ (° C.) is Mf temperature of the metal sheet, v (m/s) is a feed rate of the metal sheet, t (mm) is a thickness of the metal sheet, T (° C.) is a quenching start temperature, and d (mm) is the distance from the water surface to the rotation center of each pinch roll.

5. The method for manufacturing the metal sheet according to claim 2, wherein a distance d (mm) from a water surface to a rotation center of the pinch roll is given by the following formula:

[Math. 1]

$$v \times \frac{t(T - T_{Ms} - 150)}{1.5} \leq d \leq v \times \frac{t(T - T_{Mf} + 150)}{1.5}$$

$T_{Ms}$ (° C.) is the Ms temperature of the metal sheet, $T_{Mf}$ (° C.) is Mf temperature of the metal sheet, v (m/s) is a feed rate of the metal sheet, t (mm) is a thickness of the metal sheet, T (° C.) is a quenching start temperature, and d (mm) is the distance from the water surface to the rotation center of each pinch roll.

* * * * *